US005339871A

United States Patent [19]

Collins et al.

[11] Patent Number: 5,339,871

[45] Date of Patent: Aug. 23, 1994

[54] APPARATUS AND METHODS FOR TRANSFERRING AND METERING GRANULAR MATERIAL

[75] Inventors: Alfred L. Collins; Edwin L. Cutright, both of Powhatan; James A. DeBlasio, Midlothian; Richard H. Dickerson, Powhatan; Billy J. Kean, Jr., Chesterfield; Renzer R. Ritt, Sr., Richmond; George R. Scott, Midlothian, all of Va.

[73] Assignee: Philip Morris Incorporated, New York, N.Y.

[21] Appl. No.: 57,340

[22] Filed: May 4, 1993

[51] Int. Cl.[5] ..... B65B 43/50

[52] U.S. Cl. ..... 141/1; 141/5; 141/7; 141/59; 141/67; 141/130; 141/71; 141/81; 141/103; 422/100

[58] Field of Search ..... 141/1, 4, 5, 6, 7, 59, 141/67, 130, 238, 107, 100, 71, 81, 129; 422/99, 100

[56] References Cited

U.S. PATENT DOCUMENTS

| | | | |
|---|---|---|---|
| 3,312,151 | 4/1967 | Molins . | |
| 3,340,775 | 9/1967 | Raymond et al. . | |
| 3,348,455 | 10/1967 | Williamson et al. . | |
| 3,550,508 | 12/1970 | Wartmum et al. . | |
| 3,570,557 | 3/1971 | Molins | 141/99 |
| 3,625,118 | 12/1971 | Jackson . | |
| 3,656,517 | 4/1972 | Taylor et al. | 141/1 |
| 3,656,518 | 4/1972 | Aronson | 141/1 |
| 3,807,286 | 4/1974 | Sexstone . | |
| 3,844,200 | 10/1974 | Sexstone . | |
| 3,844,431 | 11/1974 | Aronson | 141/129 |
| 3,847,191 | 11/1974 | Armson | 141/12 |
| 3,884,741 | 5/1975 | Sexstone | 156/259 |
| 3,943,832 | 3/1976 | Sexstone . | |
| 3,957,563 | 5/1976 | Sexstone | 156/438 |
| 4,005,668 | 2/1977 | Washington et al. | 141/67 |
| 4,016,830 | 4/1977 | Sexstone | 118/406 |
| 4,090,424 | 5/1978 | Hall | 83/330 |
| 4,158,035 | 6/1979 | Haase et al. | 422/100 |
| 4,174,720 | 11/1979 | Hall . | |
| 4,184,412 | 6/1980 | Hall . | |
| 4,208,956 | 6/1980 | Hall . | |
| 4,214,508 | 7/1980 | Washington . | |
| 4,509,568 | 4/1985 | Kawaguchi et al. | 141/129 |
| 4,721,233 | 1/1988 | Asada | 222/245 |
| 4,949,766 | 8/1990 | Coatsworth | 141/67 |
| 4,974,646 | 12/1990 | Martin et al. | 141/67 |
| 5,002,103 | 3/1991 | Marescalchi | 141/71 X |
| 5,055,408 | 10/1991 | Higo et al. | 422/100 X |

FOREIGN PATENT DOCUMENTS

| | | |
|---|---|---|
| 1932607 | 6/1969 | Fed. Rep. of Germany . |
| 1106931 | 3/1968 | United Kingdom . |

*Primary Examiner*—Ernest G. Cusick

*Attorney, Agent, or Firm*—Charles E. B. Glenn; James E. Schardt; Kevin B. Osborne

[57] ABSTRACT

Methods and apparatus are provided for transferring a metered charge of granular material from a bulk source to an individual receptacle at high speed. The apparatus comprises a nozzle having suction and positive ports, a screen disposed within the nozzle, and suction and positive pressure sources that selectively communicate with the suction and pressure ports to sequentially engage a charge of granular material from a bulk source and then expel the charge of granular material into a receptacle. The apparatus includes a controller for selectively actuating valves connecting the suction and positive pressure ports to the suction and positive pressure sources. Methods of transferring a discrete charge of the granular material from a bulk reservoir to an individual receptacle are also provided.

9 Claims, 3 Drawing Sheets

APPARATUS AND METHODS FOR TRANSFERRING AND METERING GRANULAR MATERIAL

This invention relates to apparatus and methods for engaging a metered amount of granular material from a bulk reservoir, transferring the metered amount of material to a deposition site, and disposing the granular material in a receptacle.

BACKGROUND OF THE INVENTION

The development of tobacco-less smoking articles, such as those described in commonly assigned U.S. Pat. 4,966,171, required new automated methods and apparatus for high speed production assembly. The smoking article described in that patent includes a heat source and an air-permeable tube containing a granular material disposed adjacent to the heat source for generating a tobacco flavored aerosol.

One step in the assembly of that smoking article is to engage a measured amount or charge of aerosol-generating granular material from a bulk reservoir and to transfer that material to the air-permeable tube. Because the amount of granular material disposed in the tube must be maintained within precise ranges to achieve satisfactory performance, it is important that the methods and apparatus developed to accomplish this task work reliably and at high speed to facilitate automated operation.

Previously known devices for transferring charges of particulate matter from a bulk source to individual compartments are described in several prior art patents, for example, Molins, U.S. Pat. 3,570,557, Sexstone U.S. Pat. 3,844,200, and Washington et al., U.S. Pat. 4,005,668. All of these devices have in common the use of a rotating drum having a having slot or pocket through which suction is drawn to engage a charge of particulate matter from a reservoir. When the drum rotates, the slot or pocket registers with a target compartment, and the charge of particulate material is drawn into the target compartment using either suction applied at the base of the compartment or positive pressure applied to the charge of particulate matter to expel the charge of material into the target compartment. None of these previously known devices provides the capability to transfer precisely metered amounts of particulate matter to individual receptacles at target locations with high accuracy and at high speed.

In view of the foregoing, it is an object of the present invention to provide methods and apparatus for engaging a metered amount of granular material and for transferring that charge of granular material to a deposition site.

It is another object of this invention to provide methods and apparatus, suitable for high-speed automation, for disposing a metered amount or charge of granular material in a receptacle.

It is still another object of this invention to provide methods and apparatus for transferring a metered amount of granular material from a bulk reservoir to an individual receptacle with high accuracy and reliability.

SUMMARY OF THE INVENTION

The present invention provides methods and apparatus for transferring a measured quantity or charge of granular material from a bulk supply to a receptacle. While the methods and apparatus of the present invention were developed to meet a specific need encountered in the manufacture of tobacco-less smoking articles, the technology of the present invention has wide applicability in those circumstances where it is desired to transfer a measured quantity of a granular substance from a bulk supply to an individual container or receptacle. Thus, the present invention may be useful, for example, in assembling other cigarette components, and in the assembly of pharmaceuticals.

The apparatus of the present invention comprises a nozzle arrangement for engaging a metered charge of granular material from a bulk source, and for transferring that charge of material to an individual receptacle. The nozzle arrangement, which may be mounted, for example, to a conventional pick/place mechanism, includes a suction port through which vacuum is drawn to engage a charge of granular material, and a positive pressure port by which the nozzle communicates with a high pressure source to expel the charge of material into a target receptacle. The apparatus further includes pumps that communicate with the suction and positive pressure ports to effect engagement and expulsion of the granular charge and a control system that coordinates operation of the apparatus.

The method of the present invention includes the steps of engaging a charge of granular material from a bulk reservoir, translating the charge of material through a series of linear displacements to dispose the charge of granular material above a receptacle, and then expelling the charge of material into the receptacle using positive pressure or a combination of positive pressure and suction.

Further features of the invention, its nature and various advantages will be more apparent from the accompanying drawings and the following detailed description of the preferred embodiments.

DETAILED DESCRIPTION OF THE PREFERRED EMBODIMENTS

The method and apparatus of the present invention are described with reference to the transfer of granular or particulate material, such as an aerosol flavor generating material, from a bulk source to individual receptacles such as the aerosol generator tubes incorporated in the smoking article described in above-mentioned U.S. Pat. No. 4,966,171. It is to be understood that the methods and apparatus of the invention have wide application to transfer of particulate or granular material to discrete receptacles. The apparatus and methods of the present invention are intended primarily for air-permeable receptacles that permit suction to be drawn through them during the transfer operation.

Figure 1:
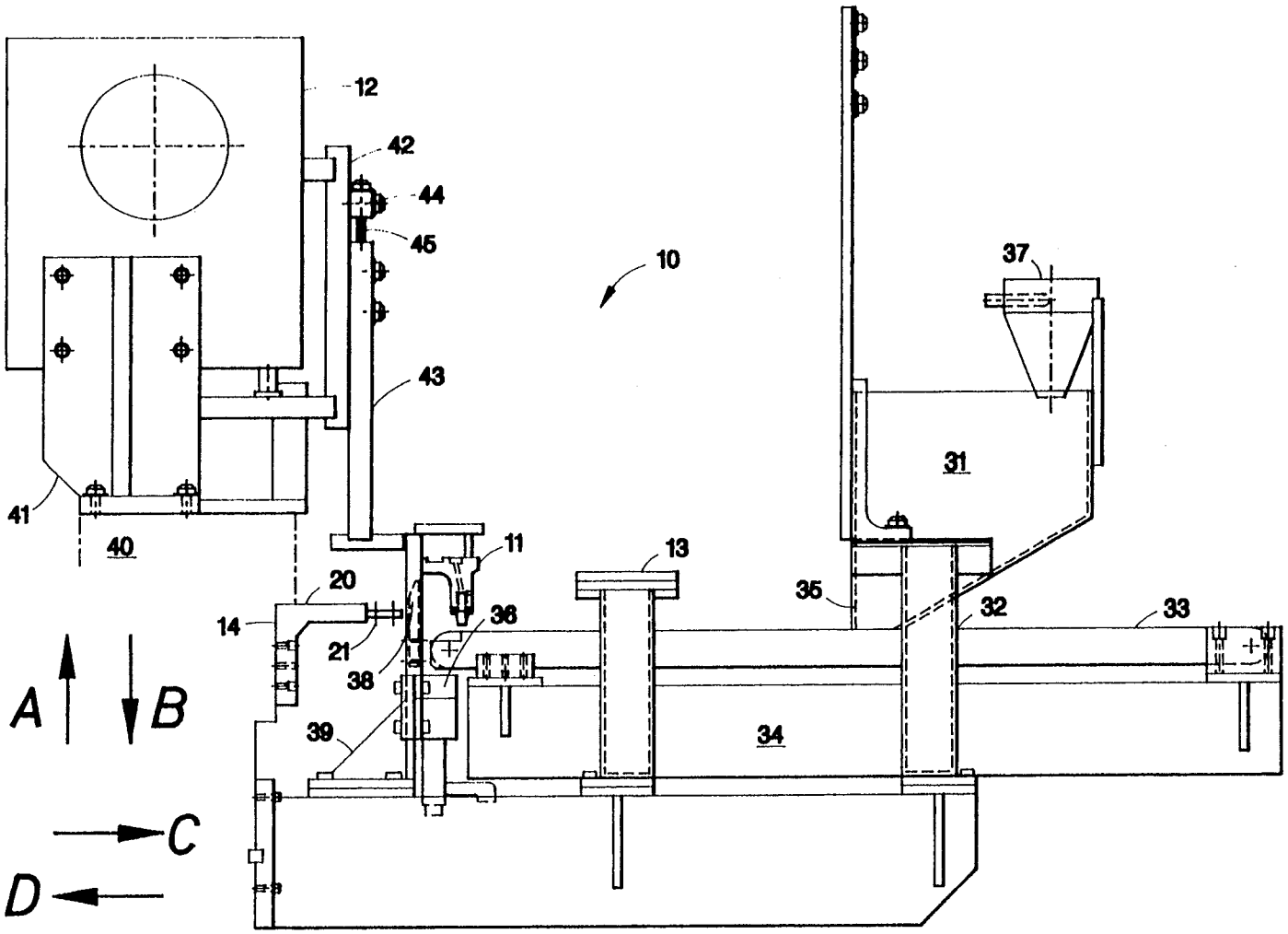
FIG. 1 is a an elevation plan view of the apparatus of the present invention.
Figure 2:
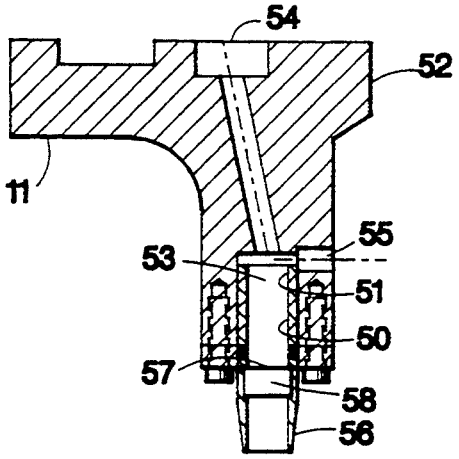
FIG. 2 is a sectional plan view of the nozzle arrangement of the apparatus of the present invention.

Referring to FIGS. 1 and 2, the apparatus of the present invention is described. Apparatus 10 of the present invention comprises nozzle array 11 mounted on conventional pick/place mechanism 12, bulk particulate feed system 13, and receptacle transfer system 14. Apparatus 10 is arranged so that pick/place mechanism moves nozzle array 11 from a first position adjacent bulk particulate feed system 13 to a second position where the nozzles of nozzle array 11 are disposed adjacent to the target receptacles carried by receptacle transfer system 14.

Figure 3:
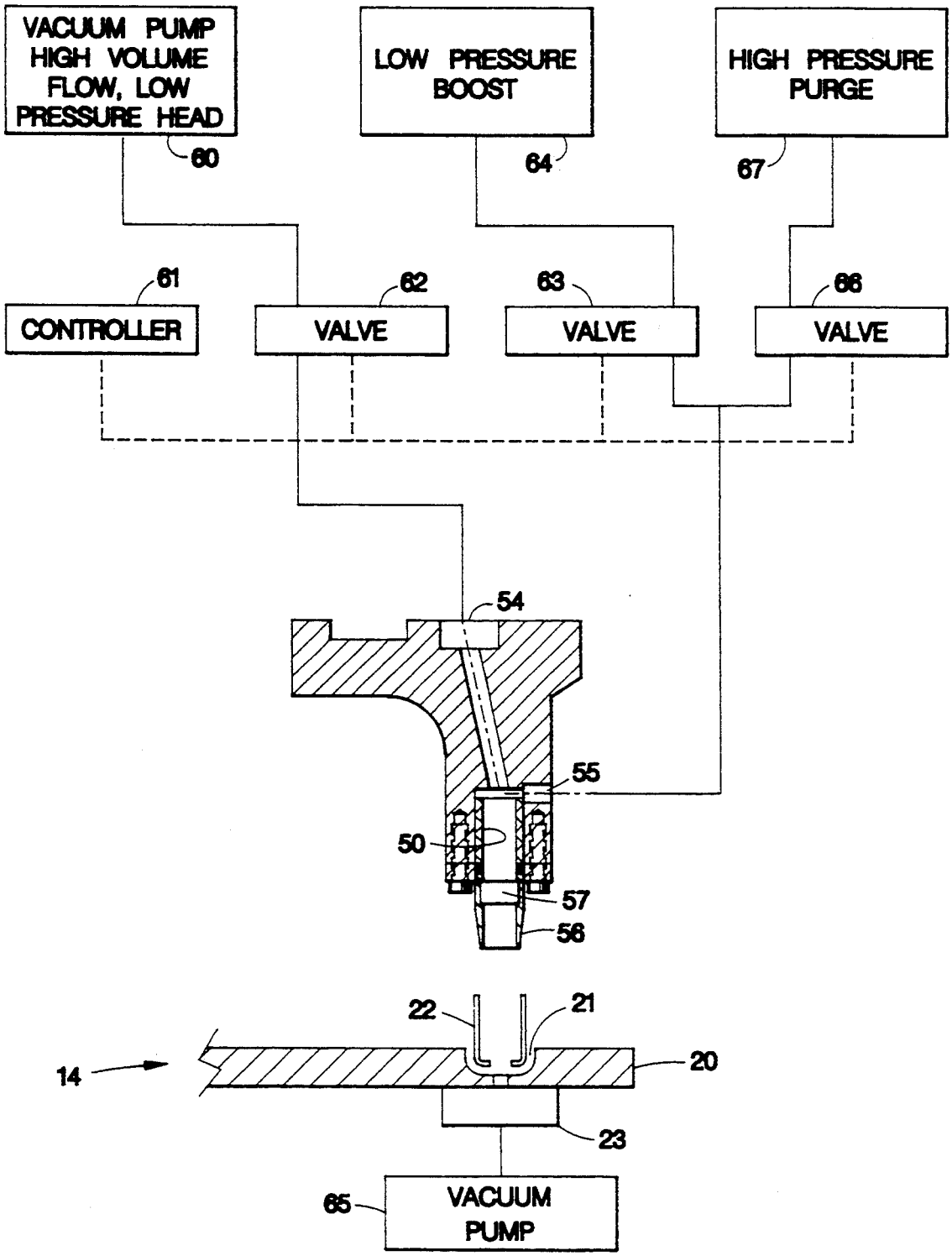
FIG. 3 is a schematic of the components of the employed by the present invention.

Receptacle transfer system 14 serves simply to bring the target receptacles into which the granular material is to be transferred into registration with applicants' novel granular material transfer apparatus, and otherwise forms no part of the present invention. Thus, as shown in FIG. 3, receptacle transfer system 14 may comprise, for example, platen 20 having holes 21 to accommodate individual receptacles 22, such as commonly found in rotary assembly systems manufactured by Swanson-Erie Corporation, Erie, Pennsylvania.

Alternatively, receptacle transfer system 14 may comprise, for example, a conveyor belt system having pockets for carrying individual receptacles. In the preferred embodiments of the present invention, it is desirable that the receptacle transfer system be arranged so that suction can be drawn through a portion of the receptacle during the transfer process, as described hereinafter.

Bulk particulate feed system 13 comprises hopper 31 mounted on vertical support member 32, endless conveyor 33 and conveyor support 34. Bulk particulate feed system 30 provides a uniform-depth bed of particulate material from hopper 31 into which nozzle array 11 is lowered, as described hereinafter. Hopper 31 includes plate 35 disposed on its outlet to restrict the flow of particulate matter from the hopper onto conveyor 33. Particulate matter carried to the end of conveyor 33 is collected by suction in trough 36 and recycled to hopper 31 through return system 37, of which only part is shown in FIG. 1. Wiper plate 38 is mounted to support member 39 to wipe off any particulate matter extending below the lower edge of nozzle array 11 at a clearance of about 0.015 inches. Conveyor 33 is operated at a sufficiently high speed that the portion of the bed of particulate material adjacent to nozzle array 11 is refreshed during each cycle of pick/place mechanism 12.

Pick/place mechanism 12 may be a conventional pick/place mechanism, for example, such as those available from Swanson-Erie Corporation, Erie, Pennsylvania. Pick/place mechanism 12 is mounted to base 40 by support plates 41, and includes slide block 42 arranged for sliding movement in directions "A" through "D" as shown in FIG. 1. Pick/place mechanism 12 also includes slide 43 mounted for vertical sliding movement in slide block 42. The upward travel of slide block 43 in direction "B" is limited by limit block 44 and adjustment screw 45.

Nozzle array 11 is disposed from the lower surface of slide block 43, and comprises a plurality of vertically oriented tubes 50 disposed in bores 51 of tube block 52. Each tube 50 has central axial passage 53 that communicates with suction port 54 and positive pressure port 55. Each tube 50 has a lower threaded portion for accepting nozzle 56. Screen 57 is secured against step 58 formed where nozzle 56 and tube 50 are fastened together. Screen 57 has openings sufficiently small so that suction can be drawn through screen 57 without particulate matter passing through the screen.

Nozzles 56 are arranged on tube block 52 so that the openings of the nozzles register with the receptacles carried by receptacle transfer system 14 when pick/place mechanism 12 moves nozzle array 11 to position "D".

Referring now to FIG. 3, suction pump 60 communicates with suction port 54 of each tube 50 to selectively draw partial vacuum through nozzle 56, thereby entraining a charge of material into nozzle 56 where it is trapped against screen 58. Once the nozzle is disposed above its target receptacle, as described below, partial vacuum through suction port 54 ceases and positive pressure is introduced to tube 50 via positive pressure port 55. This selective introduction of positive pressure into tube 50 via positive pressure port 55 expels the charge of particulate matter from against screen 57 into the target receptacle.

Transfer of the charge of particulate material from nozzle 56 into receptacle 22 may in addition be aided by suction drawn through the receptacle. As shown in FIG. 3 this supplementary suction can be provided by vacuum manifold 23 disposed beneath platen 20 of receptacle transfer system 14.

Operation of apparatus 10 comprises actuation of pick/place mechanism 12 to move slide 43 first in direction "C" and then in direction "A" so that the lower end of nozzle array 11 enters the bed of granular material carried on conveyor 33. Suction is drawn through suction port 54 and central passage 53 in tube 50 so that a charge of granular material is entrained in the airflow and engaged against screen 57 in each tube 50.

Pick/place mechanism 12 then moves slide 43 in direction "B" away from conveyor 33, and then retracts in direction "D" so that any excess granular material extending below the lower end of nozzle array 11 is wiped by wiper plate 38 into trough 36. Pick/place mechanism continues its motion in direction "D" until tube 50 is positioned over the target receptacle carried on receptacle transfer system 14, and then moves in direction "A" to bring the lower end of nozzle array 11 into contact with the receptacle.

Suction through suction port 54 ceases, and a brief burst of positive pressure is introduced into central passage 53 through positive pressure port 55, thereby expelling the charge of granular material from screen 57 into the receptacle. The receptacle, which is air permeable, includes openings sufficiently small to allow the positive pressure to dissipate without causing the burst of air and entrained charge of granular material to scatter. Partial vacuum may be drawn through receptacle 22 and vacuum manifold 23 to assist in transferring the charge of granular material from the nozzle to the receptacle. It is desirable that the positive pressure admitted in central passageway 53 and the suction drawn through manifold 23 be balanced, to ensure that the burst of positive air does not cause the charge of granular material to impinge against the receptacle and then scatter.

Pick/place mechanism 12 then retracts from receptacle transfer system 14 and returns nozzle array 11 to conveyor 33 to repeat the transfer cycle by the above-described sequence of movements. Simultaneously, an optional burst of air is admitted to central passage 53 to remove any residual granular material that may remain lodged against screen 57.

Close regulation of the suction pressure employed to engage the charge of granular material in nozzle 56, in combination with the wiping action of wiper blade 38, enables the apparatus to transfer precisely reproducible volumes of granular material. Thus, the apparatus of the present invention enables metering of the volumes of granular material even at high speeds. As will of course be understood by one skilled in the art, the volume of the charge of granular material transferred can be varied by changing the depth at which screen 57 is disposed in passage 53 of nozzle 56.

In one embodiment of the present invention, apparatus 10 includes controller 61 for coordinating operation of the vacuum and positive pressure air pumps with the movement of pick/place mechanism 12. In this embodiment, controller 61 selectively opens valve 62 to connect high volume, low pressure vacuum source 60 to suction port 56 of nozzle array 11 when pick/place mechanism 12 lowers nozzle array 11 into the bed of granular material carried on conveyor 33. Suction is continuously drawn through suction port 54 while pick/place mechanism translates nozzle array 11 to a position adjacent to the receptacle carried on receptacle transfer system 14. Once pick/place mechanism 12 positions nozzle array 11 above the receptacles carried on receptacle transfer system 14, controller 61 closes valve 62 between low pressure, high volume suction source 60 and suction port 54. Simultaneously, controller 61 opens for a brief period valve 63 between low positive pressure air source 64 and positive pressure port 55, to admit a pulse of positive pressure air into central passage 53 of tube 50. The positive pressure boost, in addition to a high volume, low pressure suction continuously drawn through receptacle 22 via manifold 23 and vacuum pump 65, serve to quickly and efficiently transfer the charge of granular material from nozzle 56 to the receptacle with a minimum of scatter or dispersion.

Once transfer of the charge of granular material to the receptacle is completed, pick/place mechanism moves slide 43 in direction "B". During translation of nozzle array 11 from positions "D" to "C" controller 61 briefly opens valve 66 between source of high pressure air 67 and positive pressure port 55, to admit a pulse of high pressure air into central passage 53 of tube 50. This high pressure pulse serves to purge any residual granular material from screen 57 and nozzle 56. Controller 61 may comprise either analog circuitry or a suitably programmed microprocessor, while valves 62, 63 and 67, may be, for example, conventional solenoid driven valves.

As will be understood from the foregoing description, the method of the present invention comprises the steps of providing a nozzle array and moving the nozzle array through a series of horizontal and vertical translations, while selectively opening and closing valves that permit suction and positive pressure to be communicated to the nozzle array. In particular, the method of the transferring granular material of the present invention comprises the steps of:

a) providing a nozzle having suction and positive ports, and an air-permeable screen disposed within the nozzle;
b) providing a bed of granular material;
c) translating the nozzle to lower it into the bed of granular material;
d) creating an airflow through the suction port, screen and nozzle by suction, the airflow entraining a charge of granular material from the bed into the nozzle and trapping the charge of granular material against the air permeable screen;
e) displacing the nozzle through a series of translations from the bed of granular material to a position located adjacent a receptacle, while maintaining the airflow through the suction port, screen and nozzle; and
f) admitting a pulse of low positive pressure into the positive pressure port and nozzle while simultaneously ceasing the airflow through the suction port, screen and nozzle, so that the pulse of positive pressure expels the charge of granular material from the nozzle into the receptacle.

The steps of the transfer method of the present invention further include the step of drawing suction through the receptacle during the step of admitting the pulse of low positive pressure into the positive pressure port, and the step of purging the nozzle and screen of any residue of the charge of granular material by admitting a pulse of high positive pressure air to the positive pressure port after the nozzle has been removed from its position adjacent the receptacle.

It will be understood that the foregoing is merely illustrative of the apparatus and methods of the present invention, and that various modifications can be made by those skilled in the art without departing from the scope and spirit of the invention.

What is claimed is:

1. A method of the transferring granular material from a bulk reservoir to a receptacle comprising the steps of:

a) providing a nozzle having suction and positive ports, and an air permeable screen disposed within the nozzle;
b) providing means for creating a bed of granular material from a bulk reservoir of granular material;
c) translating the nozzle so that it enters into the bed of granular material;
d) creating an airflow through the suction port, screen and nozzle by suction, the airflow entraining a charge of granular material from the bed into the nozzle and trapping the charge of granular material against the air permeable screen;
e) displacing the nozzle through a series of translations from the bed of granular material to a position located adjacent the receptacle, while maintaining the airflow through the suction port, screen and nozzle; and
f) admitting a pulse of low positive pressure into the positive pressure port and nozzle while simultaneously ceasing the airflow through the suction port, screen and nozzle, so that the pulse of positive pressure expels the charge of granular material from the nozzle into the receptacle.

2. The method as defined in claim 1 further comprising the step of drawing suction through the receptacle during the step of admitting the pulse of low positive pressure into the positive pressure port, to assist transfer of the charge of granular material from the nozzle to the receptacle.

3. The method as defined in claim 1 further comprising the step of purging the nozzle and screen of any residue of the charge of granular material by admitting a pulse of high positive pressure to the positive pressure port after the nozzle has been removed from its position adjacent the receptacle.

4. Apparatus for transferring granular material from a bed of granular material to a receptacle, the apparatus comprising:

a nozzle having a passageway, a suction port communicating with the passageway, a positive pressure port communicating with the passageway and an air permeable screen disposed within the passageway;

a pneumatic suction source communicating with the suction port;

a pneumatic positive pressure source communicating with the positive pressure port;

a first valve disposed between the pneumatic suction source and the suction port;

a second valve disposed between the pneumatic positive pressure source and the positive pressure port;

a controller that selectively actuates the first and second valves;

means for translating the nozzle from a first position where the controller selectively opens the first valve to connect the pneumatic suction source to the suction port to induce an airflow in the passageway that entrains a charge of granular material from the bed of granular material and traps the charge of granular material within the passageway against the air permeable screen to a second position where the controller simultaneously closes the first valve and opens the second valve to connect the pneumatic positive pressure source to the positive pressure port to introduce a pulse of positive pressure into the passageway so that the charge of granular material is expelled into the receptacle.

5. The apparatus as defined in claim 4 further comprising means for removing an excess portion of granular material from the charge of granular material so that the charge of granular material has a desired volume.

6. The apparatus as defined in claim 4 wherein the means for translating comprises a pick/place mechanism having a slide and the nozzle is disposed from the slide.

7. The apparatus as defined in claim 4 further comprising:

a pneumatic high positive pressure source communicating with the positive pressure port;

a third valve disposed between the pneumatic high positive pressure source and the positive pressure port, the third valve selectively operated by the controller to purge any residue from the passageway after the charge of granular material is expelled into the receptacle.

8. The apparatus as defined in claim 4 wherein the receptacle is carried on a receptacle transfer system, the apparatus further comprising a vacuum manifold disposed adjacent to the receptacle transfer system to induce suction through the receptacle, so that the charge of granular material expelled from the nozzle is captured in the receptacle.

9. The apparatus as defined in claim 4 wherein the bed of granular material is provided from a bulk reservoir, the apparatus further comprising:

an endless belt conveyor having a forward flight and a return flight;

a hopper for storing the bulk reservoir of granular material, the hopper including an opening that permits the granular material to flow onto the endless belt conveyor at a uniform depth to form the bed of granular material;

a trough disposed at one end of the endless belt conveyor that collects the granular material as the endless belt conveyor begins its return flight; and means for transferring the granular material from the trough to the hopper.

* * * * *